US005632309A

United States Patent [19]

Kaufmann

[11] Patent Number: 5,632,309

[45] Date of Patent: May 27, 1997

[54] GRIPPER PROJECTILE FOR A WEAVING MACHINE

[75] Inventor: Josef Kaufmann, Elsau, Switzerland

[73] Assignee: Sulzer Rueti AG, Rueti, Switzerland

[21] Appl. No.: 573,473

[22] Filed: Dec. 15, 1995

[30] Foreign Application Priority Data

Feb. 1, 1995 [EP] European Pat. Off. ..... 95810064

[51] Int. Cl.[6] ..... D03J 5/06

[52] U.S. Cl. ..... 139/196.2; 24/536; 139/438

[58] Field of Search ..... 24/536, 537; 139/438, 139/196.2

[56] References Cited

U.S. PATENT DOCUMENTS

| | | | |
|---|---|---|---|
| 3,472,286 | 10/1969 | Schneider | 139/196.2 |
| 3,845,521 | 11/1974 | McNichol | 24/536 |
| 3,854,506 | 12/1974 | Pfarrwaller | 139/196.2 |
| 3,924,303 | 12/1975 | Elliott | 24/537 |
| 3,939,878 | 2/1976 | Pfarrawaller | 139/196.2 |
| 4,516,297 | 5/1985 | Pettersson | 24/536 |
| 4,669,156 | 6/1987 | Guido et al. | 24/336 |

FOREIGN PATENT DOCUMENTS

| | | | |
|---|---|---|---|
| 55548 | 9/1912 | Austria | 24/536 |
| 771901 | 10/1934 | France . | |
| 2189554 | 1/1974 | France . | |
| 45 05 030 | 8/1994 | Germany | 139/438 |
| 6715528 | 5/1968 | Netherlands . | |

*Primary Examiner*—Andy Falik

*Attorney, Agent, or Firm*—Townsend and Townsend and Crew LLP

[57] ABSTRACT

The gripper projectile has a housing (1), a weft yarn clip (2) and a connector element (3) in order to connect the housing and the weft yarn clip. Furthermore, unitary portions protruding outward from the outer side of each respective leg are provided for biasing the clip legs in order to produce a predetermined gripping force, with the gripping force setting itself automatically on assembly of the weft yarn clip.

14 Claims, 1 Drawing Sheet

1
2
2A
3
6
7
8
11
12
13
14
15
16
17
18
21
22
24

GRIPPER PROJECTILE FOR A WEAVING MACHINE

BACKGROUND OF THE INVENTION

The invention relates to a rapier or gripper projectile for a weaving machine as well as to a weaving machine having a rapier or gripper projectile.

Rapier projectiles of this kind are known. In the known projectiles the gripping or clamping force of the weft yarn clip is set in a separate process prior to assembly of the projectile. This results in a large amount of complexity and effort as well as high production costs.

The object of the invention is to provide an improved rapier projectile for a weaving machine so that setting of the gripping force is unnecessary or is at least substantially simplified.

SUMMARY OF THE INVENTION

In one embodiment, a portion is formed on each of the legs which biases the legs against one another on insertion of the weft yarn clip into the housing.

In another embodiment, an auxiliary member is provided in order to bias the legs against one another prior to the insertion of the weft yarn clip into the housing.

It is in particular advantageous when the housing, the weft yarn clip and the connector element are made of fiber-reinforced plastic. As a result of the low normal mode frequency, the transverse oscillations caused by the pick, i.e. impact of the acceleration lever and the lateral picks in the guide channel are avoided to the greatest possible extent. Moreover, oscillations produced on entry into the catcher brake are also avoided to the greatest possible extent. Consequently, weft faults resulting from yarn loss do not occur or occur only occasionally. Moreover, Moreover, this rapier projectile has a low mass so that the acceleration torque and consequently the braking force can be reduced. This results in a better energy balance overall and also the possibility of working with fine and easily broken weft yarns without breakdown.

BRIEF DESCRIPTION OF THE DRAWINGS

The invention will be described in the following by means of example only with the aid of the enclosed drawings.

DESCRIPTION OF THE PREFERRED EMBODIMENTS

Figures 1, 2, 3, 4, 5:
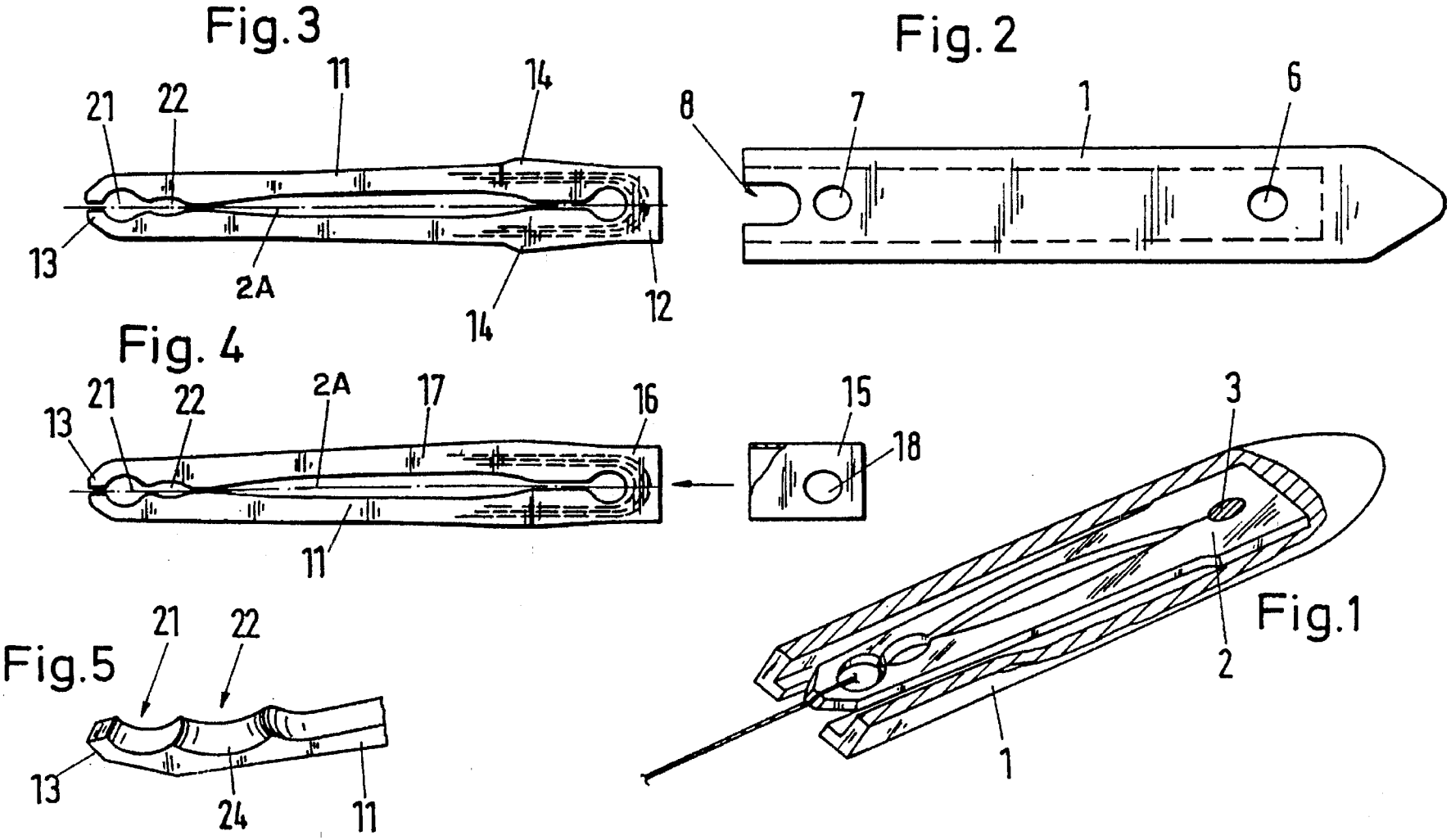
FIG. 1 shows a rapier projectile made in accordance with the invention in perspective view.
FIG. 2 is a plan view onto the housing of the rapier projectile of FIG. 1.
FIG. 3 is a plan view onto the weft yarn clip of the rapier projectile of FIG. 1.
FIG. 4 is a plan view onto another embodiment of a weft yarn clip in accordance with the invention.
FIG. 5 is a portion of a further embodiment of a weft yarn clip made in accordance with the invention in perspective view.

The rapier projectile comprises a housing 1, a weft yarn clip 2 arranged in the housing and a connector element 3 which connects the housing 1 to the weft yarn clip 2.

The housing 1 is for example formed as a hollow body closed on one side and has an outer shape typical for rapier projectiles. The hollow cavity has a quadrilateral cross-section. In the region of the hollow cavity a first hole 6 is provided for receipt of the connector element 3 and a second hole 7 for introduction of an opening member for the weft yarn clip 2. Each of these holes passes through the oppositely disposed sidewalls. Moreover, a recess 8 is provided in each of the sidewalls in the region of the open end of the hollow volume.

The weft yarn clip comprises two legs 11 and a yoke 12. Inwardly directed portions 13 are formed at the free ends of the legs and form the gripping jaws for the weft yarn. Each leg has a unitary protruding portion 14 sticking out from the outer side of the respective leg. The weft yarn clip is comprised of an elastically deformable material, so that the legs 11 can be biased or pretensioned against one another via deformation of the yoke 12.

The connector element 3 has a round cross-section and is designed so that it is connected with a press fit to the housing 1 and the weft yarn clip 2 and so that its end faces are flush with the surfaces of the housing 1. The housing 1 and the weft yarn clip 2 can be made of metal or non-metal.

In a preferred embodiment, the housing 1, the weft yarn clip 2 and the connector element 3 are made of fiber-reinforced elastic.

The housing 1 is a one-piece body manufactured by an injection or pressing process and is made of thermal plastic or duroplastic. Carbon fibers, aramid fibers, glass fibers or metal inserts are used for reinforcement.

The weft yarn clip 2 is a one-piece body made of layered plastic and manufactured from a plastic plate by mechanical processing, for example by water jet cutting, or is manufactured by an injection process or a pressing process and is made of a thermal plastic or a duroplastic. Carbon fibers, aramid fibers, glass fibers or metal inserts are used for strengthening.

The connector element has a pin-like form with the fiber reinforcement being aligned in the axial direction.

As already mentioned, the weft yarn clip can for example be manufactured by water jet cutting so that the body is strain free. The portions 14 are formed identically the same relative to the line of symmetry 2A of the weft yarn clip and are so dimensioned that on insertion of the weft yarn clip into the hollow cavity of the housing 1 these portions 14 come into contact with the walls of the housing so that legs 11 of the weft yarn clip 2 are biased towards one another and the gripping jaws are pressed together. The gripping force can be determined by the design of the dimensions of the portions 14 and the gripping force set automatically by the insertion of the clip.

FIG. 4 shows another embodiment of the weft yarn clip in a disassembled, i.e. exploded, representation. In this weft yarn clip, the setting, i.e. adjustment of the gripping force, is implemented prior to the incorporation into the housing. A collar 15 which is slid over the yoke 12 is provided for this. In so doing the legs 12 are pressed together in the same manner as in the above-described embodiment and thus the gripping force is set. To mount the collar 15, the thickness of the yoke 16 is designed such that the surface of the collar 15 is, when slid on, flush with the surface 17 of the legs. The weft yarn clip 2 is placed together with the collar 15 into the housing 1 and secured in the housing 1 by the connector element 3. A hole 18 is provided for this in each of the oppositely lying walls of the collar 15. In this embodiment, the gripping force can be determined by the dimensional design of the leg portions adjacent to the yoke and the gripping force sets itself automatically on sliding the collar into place.

Each leg has a first recess at its free end and a second recess arranged subsequent thereto, these recesses being formed on the oppositely lying inner side of the legs, thus forming openings 21 and 22. An opener member (not shown) is inserted into the second opening in order to splay the legs 11. The gripping force is thus counteracted and the weft yarn released.

As shown in FIG. 5, with a plastic weft yarn clip, the second recess 22 can be provided with a protection means, for example a cover member 24 or a coating in order to prevent material loss from the opener member and consequently to lengthen the lifetime of the rapier projectile. A protection means of this kind can also be provided at the gripping jaws 13.

The rapier projectile has a housing 1, a weft yarn connector 2 and a connector element 3 in order to connect the housing and the weft yarn clip. Furthermore, means 14, 15 are provided for biasing the clip legs in order to produce a predetermined gripping force, with the gripping force setting itself automatically on assembly of the weft yarn clip.

What is claimed is:

1. A weaving machine comprising:

a gripper projectile including a housing formed as a hollow body; and a weft yarn clip arranged in the housing, having a line of symmetry, and a connector element connecting the housing to the weft yarn clip so that the weft yarn clip and the housing are prevented from moving relative to each other along the line of symmetry, the weft yarn clip comprising a pair of legs defining between them a jaw for gripping a yarn and having a recess for splaying the jaws, a yoke connecting the legs and unitary protruding portions on the legs, formed identically relative to the line of symmetry, for bringing the clip legs into operative engagement with the housing and thereby biasing the clip legs toward one another in order to generate a predetermined gripping force at the jaw.

2. Gripper projectile for a weaving machine comprising a housing formed as a hollow body; and a weft yarn clip arranged in the housing, having a line of symmetry, and a connector element connecting the housing to the weft yarn clip so that the weft yarn clip and the housing are prevented from moving relative to each other along the line of symmetry, the weft yarn clip comprising a pair of legs defining between them a jaw for gripping a yarn and having a recess for splaying the jaws, a yoke connecting the legs and unitary protruding portions on the legs, formed identically relative to the line of symmetry, for bringing the clip legs into operative engagement with the housing and thereby biasing the clip legs toward one another in order to generate a predetermined gripping force at the jaw.

3. A gripper projectile as set forth in claim 2, wherein the protruding unitary portions are each formed on sides of the clip legs facing away from one another.

4. A gripper projectile as set forth in claim 2, comprising an auxiliary member, wherein the auxiliary member is positioned onto the protruding unitary portions and biases the clip legs toward one another in order to generate the predetermined gripping force at the jaw.

5. A gripper projectile as set forth in claim 2, wherein the housing is made of metal.

6. A gripper projectile as set forth in claim 2, wherein the weft yarn clip is made of metal.

7. A gripper projectile as set forth in claim 2, wherein the housing and the weft yarn clip are made of the same material.

8. A gripper projectile as set forth in claim 2, wherein at least one of the housing and the weft yarn clip is made of fiber-reinforced plastic.

9. A gripper projectile as set forth in claim 2, wherein at least one of the housing and the weft yarn clip is made of metal-reinforced plastic.

10. A gripper projectile as set forth in claim 2, wherein the housing is an injection molded component.

11. A gripper projectile as set forth in claim 2, wherein the housing and the weft yarn clip are made of different material.

12. A gripper projectile as set forth in claim 2, wherein the housing is a pressed component.

13. A gripper projectile as set forth in claim 2, wherein the weft yarn clip is made of non-metal.

14. A gripper projectile as set forth in claim 2, wherein the housing is made of non-metal.

* * * * *